US005092765A

United States Patent [19]

Wahlfeld

[11] Patent Number: 5,092,765

[45] Date of Patent: Mar. 3, 1992

[54] METHOD AND ARRANGEMENT FOR HOT REPAIR OF HEATING TRAINS OF COKE OVEN BATTERY

[75] Inventor: Werner Wahlfeld, Dahlem, Fed. Rep. of Germany

[73] Assignee: Krupp Koppers GmbH, Essen, Fed. Rep. of Germany

[21] Appl. No.: 592,515

[22] Filed: Oct. 4, 1990

[30] Foreign Application Priority Data

Oct. 6, 1989 [DE] Fed. Rep. of Germany ..... 3933364

[51] Int. Cl.[5] ..... F27D 1/16; F24H 3/00

[52] U.S. Cl. ..... 432/3; 264/30; 165/47

[58] Field of Search ..... 432/3; 264/30; 165/47

[56] References Cited

U.S. PATENT DOCUMENTS

| | | | |
|---|---|---|---|
| 4,189,457 | 2/1980 | Clement, Jr. | 264/30 |
| 4,364,798 | 12/1982 | Costa | 264/30 |
| 4,436,678 | 3/1984 | Nishikawa et al. | 264/30 |
| 4,452,749 | 6/1984 | Kolvek et al. | 264/30 |

FOREIGN PATENT DOCUMENTS

| | | | |
|---|---|---|---|
| 0082073 | 6/1983 | European Pat. Off. | 264/30 |
| 1274552 | 8/1968 | Fed. Rep. of Germany | 432/3 |
| 0116718 | 7/1981 | Japan | 264/30 |
| 0098582 | 6/1982 | Japan | 264/30 |
| 0071984 | 4/1983 | Japan | 264/30 |
| 0187081 | 10/1984 | Japan | 264/30 |

*Primary Examiner*—Henry A. Bennet
*Attorney, Agent, or Firm*—Michael J. Striker

[57] ABSTRACT

A method of hot repair heating trains of a coke oven battery includes brick laying of a heating train, warming a finished portion of a respective heating train during the brick laying to a temperature of approximately 250° C., directly after ending the brick laying heating a new heating train to a temperature of approximately 500° C., performing the warming and heating by means of gaseous heat carrier, blowing the heat carrier into the heating trains and heating the heat carrier in a heat exchange with use of heat of hot parts of the coke oven battery.

8 Claims, 3 Drawing Sheets

1
12
2
3
11
10
6
7
9
5
4

5
1
17
16
21
15
24
20
14
23
19
13
22
28
8
25
26
27
29
30
18

METHOD AND ARRANGEMENT FOR HOT REPAIR OF HEATING TRAINS OF COKE OVEN BATTERY

BACKGROUND OF THE INVENTION

The present invention relates to a method of and an arrangement for hot repair of heating trains of a coke oven battery.

During the hot repair of heating trains of a coke oven battery the heating trains to be repaired or to be renovated are protected from the remaining hot parts of the coke oven by separating walls provided with a refractory coating (so-called mirrors). During the- heating the heating train to be repaired is switched off, and the remaining heating trains are again heated. The heating trains to be repaired or to be renovated are first completely laid with bricks from the floor of the coke oven to the top. After the end of this work, the new masonry is heated with warm air from the not renovated hot part of the coke oven through respective openings in the separating walls and in some cases also by additionally heated exhaust gas. In other words, in this phase the residual heat is transferred from the heated heating train by convection to the freshly brick laid heating train. For the heating required at the end of the warming, the new heating train must be again connected to the regenerative heating system of the coking oven.

The above specified operation can be used only for coking ovens with a chamber height up to 5 m and moreover, limited to two, at most three heating trains. For coke ovens with chamber heights above 5 m and more than three heating trains to be renovated it, is not possible with the known operations to control warming and heating steps. Due to heat drops occurring in the new masonry different expansion conditions occur. As a result it leads to formation of cracks, joints and breakage in new masonry. It leads to a loose masonry which is not absolutely gas tight. It is very undesirable development due to negative influence on the heat maintenance and progress of the coking process.

SUMMARY OF THE INVENTION

Accordingly, it is an object of the present invention to provide a method of hot repair of heating trains of a coke oven which is improved so as to avoid the above mentioned disadvantages of the prior art, wherein the use of the improved method is possible especially for coke ovens with a chamber height of more than 5 m.

In keeping with these objects and with others which will become apparent hereinafter, one feature of the present invention resides, briefly stated, in a method in accordance with which during the hot brick laying of the heating train a heating of the finished portion of the respective heating train is performed to a temperature of approximately 250° C. and directly after the end of the brick laying works the new heating train is heated to a temperature of approximately 500° C., the heating of the finished portion of the respective heating train and the heating of the new heating train is performed by a gaseous heat carrier which is blown into the heating trains and heated in a heat exchange with the use of the heat of the hot parts of the coke oven battery.

It is advantageous when the temperature during the brick laying of a heating train is adjusted so that it corresponds to the temperature of the neighboring heating train after the isolation stripping of the binder wall. In other words, the new brick work must have horizontally the same temperature and thereby the same expansion as the neighboring brick work.

In accordance with the inventive method and in contrast to the conventional methods, a heating is performed during the hot brick laying of the heating train. The finished brick laid portion of the respective heating train is closed upwardly by a cover plate provided with a refractory coating, and in its center an opening is arranged with for example a tubular chimney. The gaseous heat carrier is blown into the space underneath the cover plate and heats in this manner the already brick laid portion of the respective heating train. Though the chimney is located in the cover plate, the correspondingly cooled heat carrier can be then discharged without influencing the brick work located above the cover plate. With the progress of the brick laying works, the cover plate is removed from its previous position and placed higher, so that the freshly brick laid parts of the heating train located under the plate can be correspondingly heated. In other words, during the hot brick laying of the heating train, the position of the cover plate is displaced from below upwardly in a stepped manner. The cover plate serves simultaneously as a brick protecting and mortar catching plate. Therefore the freshly brick laid parts of the heating train located under the plate are not damaged by falling stone particles or mortar. When the brick laying works are finished, the cover plate is removed and the freshly brick laid heating train is heated to the desired temperature of approximately 500° C.

Pressure air can be used as gaseous heat carrier for the heating of the finished portion of the respective heating train and of the new heating train. It is naturally also possible to use another gas for this purpose, such as for example smoke gas or nitrogen when for certain reasons it must be applied, for example for heating of the heating train. The heating of the gaseous heat carrier required for the inventive process is performed in indirect heat exchange with hot parts of the coke oven battery. There are naturally different possibilities which will be illustrated hereinbelow. The construction of the heat exchanger used for this purpose depends, first of all, on the location specifics in the part of the coke oven battery in which the heat exchanger must be installed, as well as on the structural considerations of the respective coke oven battery. Preferably, the heat exchanger is formed as a pipe coil composed of one or several hairpin-shaped bent windings. The inlet opening for the gas heat carrier lies at the cold end of the heat exchanger, while the heat carrier passes through the heat exchanger and finally is supplied with correspondingly increased temperature to the heating train to be repaired. This temperature can be controlled in a known manner by regulating the throughflow quantity of the heat carrier per time unit. Armature such as valves, sliders and/or perforated discs can be used for this purpose. They are preferably arranged on the cold end of the heat exchanger.

A possibility for heating of the gaseous heat carrier is for example provided in the heat exchanger which is formed as hairpin-shaped bent wire coil when the pipe is arranged on the upper edge of the regenerator associated with the heating train to be repaired. The heat carrier during passing through the pipe coil is heated by heat from the regenerator and then blown at the hot end of the pipe coil into the connecting passage between the regenerator and the heating train to be repaired. The heat carrier flows through the connecting passage into the heating train in which it is used as described hereinabove. In accordance with this method a separate pipe coil is required for the heating train to be repaired.

Another possibility for heating of the gaseous heat carrier resides in that the heat exchanger formed as a hairpin bent pipe coil is arranged not on the regenerator but on the floor of the oven chamber which lies near the heating train to be repaired. In this arrangement which is suitable especially for the repair of the front heating train lying in the region of the heating train head, the heating train to be repaired is separated from the remaining hot heating trains by a partition provided in the oven chamber and having a refractory coating. This partition has throughgoing openings at its lower end for the pipe coil, so that the pipe coil can extend to the hot part of the oven chamber. The heater required for heating of the heat carrier is available from the hot part of the oven chamber.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
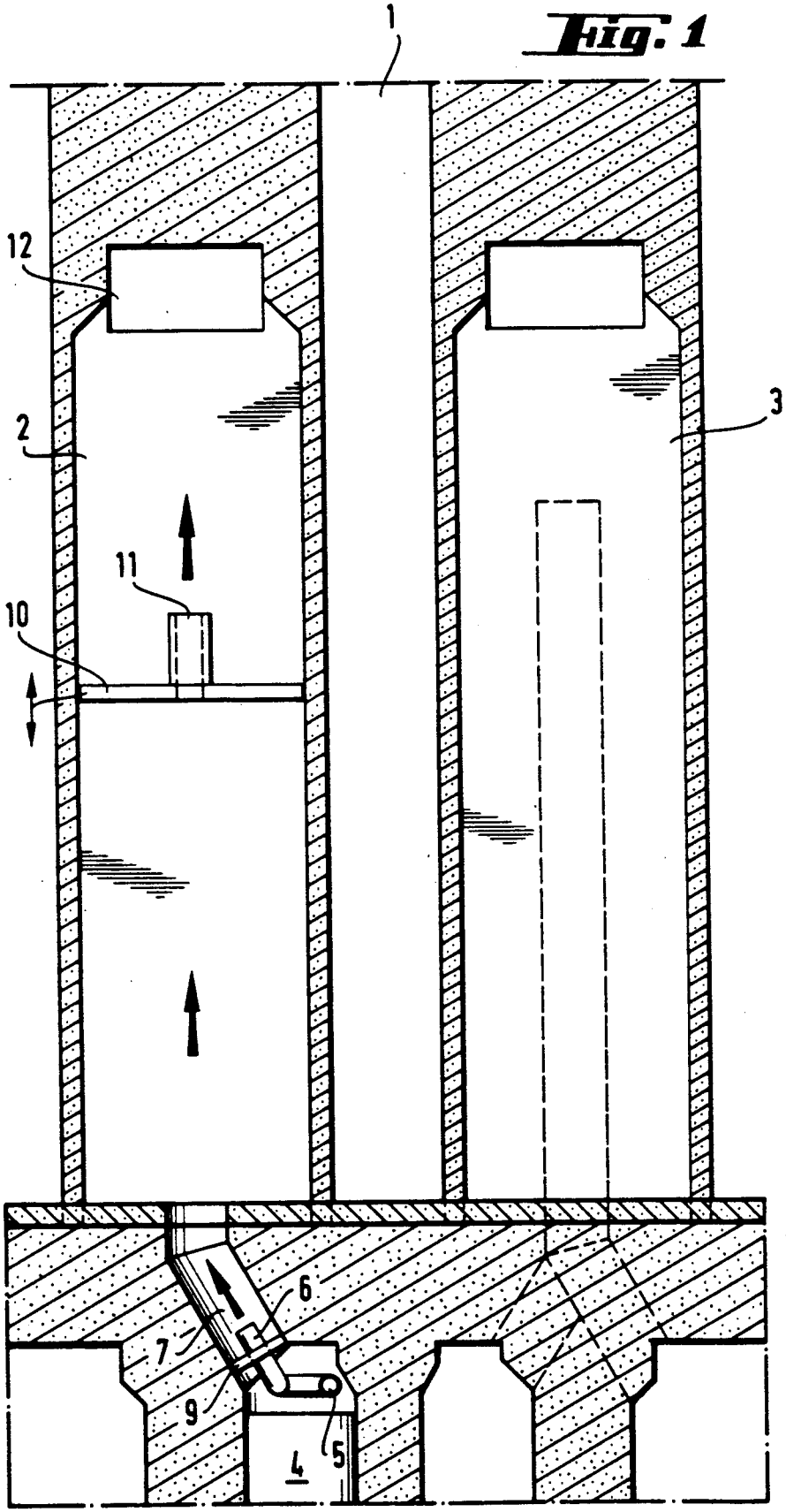
FIG. 1 is a vertical section through two heating trains of a coke oven battery with an oven chamber located therebetween, wherein a pipe coil serves as a heat exchanger and arranged on a regenerator for the heating train to be repaired.

FIG. 1 shows an oven chamber 1 with heating trains 2 and 3 which are located opposite to one another. The left heating train 2 must be subjected to a hot repair. For this purpose a pipe coil which operates as a heat exchanger is arranged on the upper edge of a regenerator 4 associated with the left heating train 2. The pipe coil 5 is subjected to the action of pressure air at its inlet opening located outside of the regenerator. An outlet opening 6 of the pipe coil 5 opens in a connecting passage 7-which connects the regenerator 4 with the heating train 2. The pressure air heated in the pipe coil 5 flows from the connecting passage 7 to the heating train 2. The required sealing between the outlet opening 6 and the connecting passage 7 is obtained by a plate 9. The plate is composed of VA-steel and provided with a refractory coating.

In this case in the heating train 2 the repair works in the lower portion are completed. Above this repaired portion a cover plate 10 is located. It separated the repaired part from the non-repaired part of the heating train 2. The heated air blown in the heating train 2 can flow freely into the upper part of the heating train. The pressure air serves for heating the finished brick laid part of the heating train located underneath the cover plate 10. Corresponding cooled pressure air can after this escape through a chimney 11 located in the cover plate 10 without affecting the masonry work above the cover plate 10.

With the progress of this work, the position of the cover plate 10 is successively displaced upwardly so that the finished portion of the heating train 2 can be heated to approximately 250° C., as long as the repair of the heating train is not completed. After the repair of the heating train 2 is completed, the cover plate 10 is removed and the temperature of the supplied pressure air is increased so that the heating train is heated to a temperature of approximately 500° C. A design of the pipe coil 5 which especially suitable for this purpose is described hereinbelow in connection with FIG. 3.

Reference numeral 12 identifies a transition to a neighboring heating train. The construction of the heating train 3 substantially corresponds to the construction of the heating train 2, so that the details of it do not have to be repeated.

Figure 2:
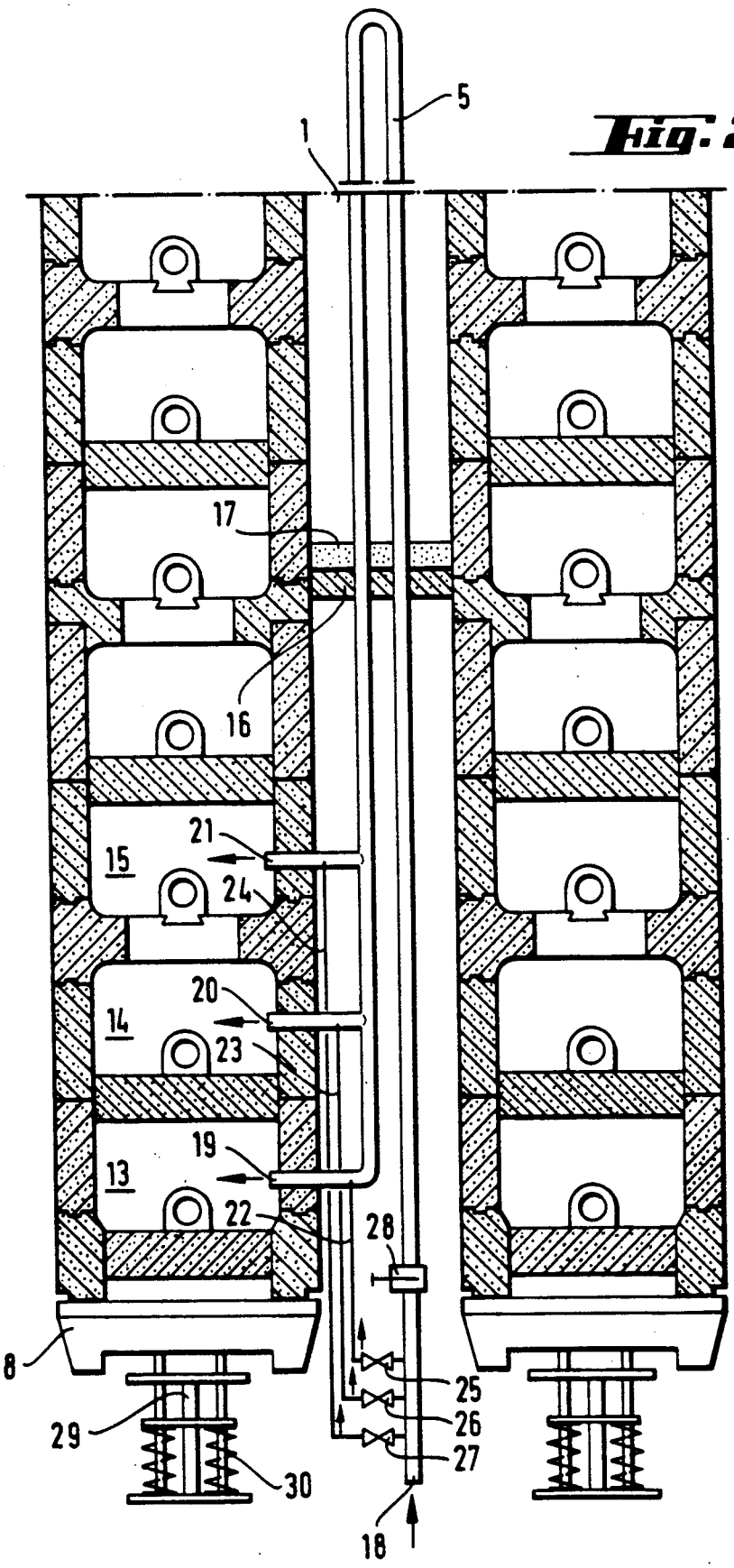
FIG. 2 is a horizontal section through two heating trains of a coke oven battery with an oven chamber located therebetween, wherein in this case the heat exchanger formed as a pipe coil is arranged on the floor of the oven chamber.

In FIG. 2 the pipe coil 5 is arranged on the floor of the oven chamber 1. In this case the front heating train 13, 14, and 15 located in the region of the heating train head are repaired simultaneously. The rear, hot part of the oven chamber 1 is separated from the front part by a partition 16 provided with a refractory coating 17. The partition 16 has throughgoing openings at its lower end for the pipe coil 5, so that it can extend into the hot part. The pressure air blown through the inlet opening 18 into the pipe coil 5 is respectively heated in the rear hot part of the oven chamber 1. At the hot end of the pipe coil 5, the notch conduits 19, 20 and 21 are arranged. The heated pressure air is supplied through these conduits into the heating trains 13, 14 and 15 to be repaired.

Bypass conduits 22, 23, 24 and are connected with the notch conduits 19, 20 and 21. Through the bypass conduits the cold pressure air can be blown from the pipe coil 5 for temperature regulation, into the notch-conduits 19, 20 and 21. The valves 25, 26 and 27 serve for regulating the pressure air supply through the pipe bypass conduits 22, 23 and 24. The pressure air supply into the pipe coil 5 can be controlled also by a slider 28. It is to be understood that it is also possible to control the valves 25, 26 and 27 and also the slide 24 by thermal elements in dependence on the desired temperature. From FIG. 2 it can be seen that an anchor support 29 with associated spring element 30 is provided, as well as a wall protective plate 8. The brick laying of the heating train to be repaired is shown in FIG. 1.

Figure 3:
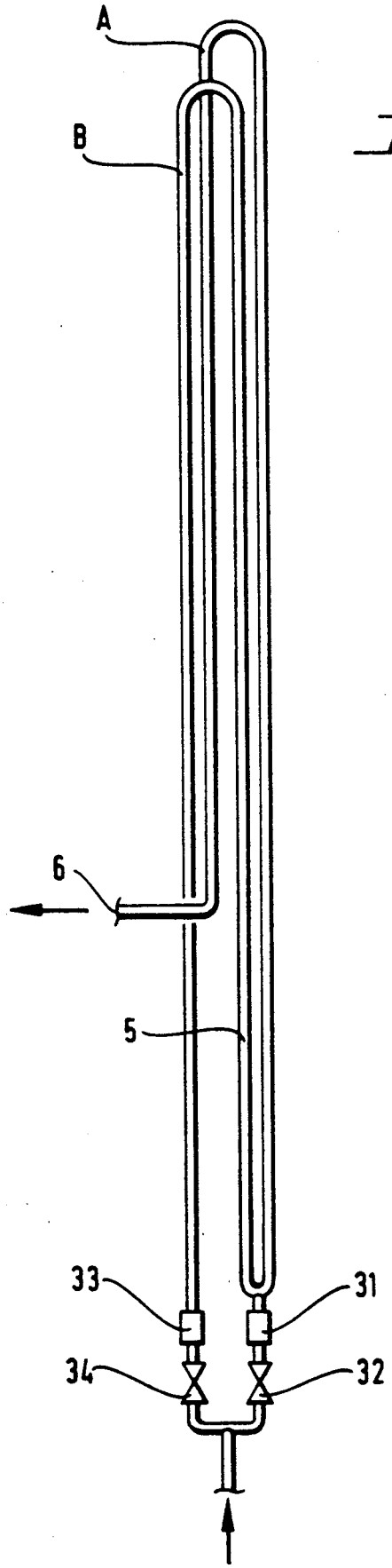
FIG. 3 is a view showing an embodiment of the pipe coil which forms the heat exchanger.

FIG. 3 finally shows an especially advantageous embodiment of the pipe coil 5 which serves as a heat exchanger. It is composed in this case of two hairpin bent pipe pieces A and B. For heating of the pressure air or other gaseous heat carrier during the brick laying of the heating train, the utilized heat carrier is supplied with an oven valve 32 through a connection 31 into the pipe coil 5. Since the valve 34 remains closed, the heat carrier flows only into the pipe piece A and finally, through the outlet opening 6 reaches a not shown heating train. After the end of the repair works, for warming the heating train to which the heating must be converted, the valve 32 is closed and the valve 34 is opened. Thus, the heat carrier first enters through a connection 32 into the pipe piece B flows both through the pipe piece B and then through the pipe piece A. Due to longer flow path connected with it naturally a stronger heating of the heat carrier in the pipe coil 5 occurs. Therefore, it has a higher temperature required for the heating of the heating train.

The method in accordance with the present invention has the following advantages:

1. By heating during the brick laying of the heating train the tension cracks, joint lifting or opening of connecting joints are eliminated. The new heating trains are absolutely gas tight.

2. The heating of the new heating train is performed simultaneously, and therefore the heating time is significantly reduced.

3. The inventive process is designed for repair of the heating trains of coke ovens with chamber height above 5 m. Thereby in these cases a new construction is eliminated, which naturally leads to a significant cost reduction.

4. The production drop due to the repair works is minimized in that the remaining not affected coke ovens of the coke oven battery can be further operated.

It will be understood that each of the elements described above, or two or more together, may also find a useful application in other types of constructions differing from the types described above.

While the invention has been illustrated and described as embodied in a method of hot repair of heating trains of a coke oven battery, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of hot repair heating trains of a coke oven battery, comprising the steps of brick laying a heating train; warming a finished portion of a respective heating train during the brick laying to a temperature of approximately 250° C.; directly after ending the brick laying heating a new heating train to a temperature of approximately 500° C.; performing the warming and heating by means of gaseous heat carrier; blowing the heat carrier into the heating trains and heating the heat carrier in a heat exchange with use of heat of hot parts of the coke oven battery.

2. A method as defined in claim 1, wherein the gaseous heat carrier is pressurized air.

3. A method of hot repair heating trains of a coke oven battery, comprising the steps of brick laying a heating train; warming a finished portion of a respective heating train during the brick laying to a temperature of approximately 250° C.; directly after ending the brick laying heating a new heating train to a temperature of approximately 500° C.; performing the warming and heating by means of gaseous heat carrier; blowing the heat carrier into the heating trains and heating the heat carrier in a heat exchange with use of heat of hot parts of the cook oven battery; and separating, during the brick laying of the heating train, a finished portion of a respective one of the heating trains from a not finished portion of the heating trains by a cover plate provided with a chimney.

4. A method as defined in claim 3 and further comprising the step of displacing a position of the cover plate with progressing of the brick laying in a stepped manner.

5. A method of hot repair heating trains of a coke oven battery, comprising the steps of brick laying of a heating train; warming of a finished portion of a respective heating train during the rick laying to a temperature of approximately 250° C.; directly after ending the brick laying heating a new heating train to a temperature of approximately 500° C; performing the warming and heating by means of gaseous heat carrier; blowing the heat carrier into the heating trains and heating the heat carrier in a heat exchange with use of heat of hot parts of the coke oven battery and arranging a heat exchanger for a heat exchange of the gaseous heat carrier.

6. A method as defined in claim 5, wherein said arranging includes arranging the heat exchanger on a regenerator associated with a heating train to be repaired.

7. A method as defined in claim 5, wherein said arranging includes arranging the heat exchanger on a bottom of an oven chamber which is adjacent to a heating train to be repaired.

8. A method as defined in claim 5, wherein said arranging includes arranging a heat exchanger which is formed as a pipe coil composed of at least one hairpin curved pipe piece provided with a connection which is closeable by a valve and used for supplying a cold gaseous heat carrier.

* * * * *